US011199865B2

(12) United States Patent
Kang et al.

(10) Patent No.: US 11,199,865 B2
(45) Date of Patent: Dec. 14, 2021

(54) BANDGAP REFERENCE VOLTAGE GENERATING CIRCUIT

(71) Applicant: SAMSUNG ELECTRONICS CO., LTD., Suwon-si (KR)

(72) Inventors: Hyunwook Kang, Hwaseong-si (KR); Cheheung Kim, Yongin-si (KR); Hyeokki Hong, Suwon-si (KR); Sungchan Kang, Hwaseong-si (KR); Yongseop Yoon, Seoul (KR); Choongho Rhee, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/887,002

(22) Filed: May 29, 2020

(65) Prior Publication Data

US 2021/0157351 A1 May 27, 2021

(30) Foreign Application Priority Data

Nov. 25, 2019 (KR) ..... 10-2019-0152595

(51) Int. Cl.
*G05F 3/30* (2006.01)
*G05F 3/22* (2006.01)

(52) U.S. Cl.
CPC ..... *G05F 3/225* (2013.01); *G05F 3/30* (2013.01)

(58) Field of Classification Search
None
See application file for complete search history.

(56) References Cited

U.S. PATENT DOCUMENTS 7,071,767 B2 * 7/2006 Ou-yang ..... G05F 3/30 327/539
7,119,528 B1 * 10/2006 Rasmus ..... G05F 3/30 323/317
7,482,798 B2 * 1/2009 Han ..... H02M 1/4225 323/316

(Continued)

FOREIGN PATENT DOCUMENTS

KR 10-2009-0048295 A 5/2009
KR 10-2015-0111581 A 10/2015
KR 10-2016-0038665 A 4/2016

OTHER PUBLICATIONS

Yunwu Zhang et al. "1 ppm/° C bandgap with multipoint curvature-compensation technique for HVIC" Electronics Letters, vol. 50, No. 25, Dec. 4, 2014, (pp. 1908-1910).

(Continued)

*Primary Examiner* — Jeffery S Zweizig
(74) *Attorney, Agent, or Firm* — Sughrue Mion, PLLC

(57) ABSTRACT

A bandgap reference voltage generating circuit includes a first current generator generating a first complementary-to-absolute temperature (CTAT) current and a first proportional-to-absolute temperature (PTAT) current, a second current generator generating a second CTAT current and a second PTAT current, and an output circuit outputting a reference voltage based on a difference between a first voltage based on the first CTAT current and the first PTAT current and a second voltage based on the second CTAT current and the second PTAT current, wherein the first CTAT current is cancelled by the second CTAT current.

19 Claims, 10 Drawing Sheets

(56) References Cited

U.S. PATENT DOCUMENTS

| | | | | |
|---|---|---|---|---|
| 7,511,568 | B2 * | 3/2009 | Kimura | G05F 3/30 327/538 |
| 7,768,343 | B1 | 8/2010 | Sinitsky | |
| 8,106,707 | B2 * | 1/2012 | Katyal | G05F 3/30 327/539 |
| 8,648,648 | B2 * | 2/2014 | Choi | G05F 3/30 327/539 |
| 9,958,895 | B2 * | 5/2018 | Chen | G05F 3/30 |
| 10,216,213 | B2 * | 2/2019 | Chu | G05F 3/30 |
| 10,671,109 | B2 * | 6/2020 | Ibrahim | G05F 3/262 |
| 2003/0006747 | A1 | 1/2003 | Jaussi et al. | |
| 2004/0124825 | A1 | 7/2004 | Marinca | |
| 2005/0035812 | A1 | 2/2005 | Xi | |
| 2005/0140428 | A1 | 6/2005 | Tran et al. | |
| 2005/0194957 | A1 | 9/2005 | Brokaw | |
| 2007/0176591 | A1 | 8/2007 | Kimura | |
| 2008/0088361 | A1 | 4/2008 | Kimura | |
| 2009/0121699 | A1 | 5/2009 | Park et al. | |
| 2009/0160537 | A1 | 6/2009 | Marinca | |
| 2009/0160538 | A1 | 6/2009 | Marinca | |
| 2009/0243708 | A1 | 10/2009 | Marinca | |
| 2012/0169413 | A1 | 7/2012 | Choi | |
| 2016/0091916 | A1 | 3/2016 | Chang et al. | |
| 2016/0274616 | A1 | 9/2016 | Roy | |
| 2017/0147028 | A1 | 5/2017 | Arnold et al. | |

OTHER PUBLICATIONS

Ruocheng Wang et al. "A Sub-1 ppm/° C Current-Mode CMOS Bandgap Reference With Piecewise Curvature Compensation" IEEE Transactions on Circuits and Systems—I: Regular Papers, Dec. 7, 2017, (10 pages total).

Jing-Hu Li et al. "A 1.2-V Piecewise Curvature-Corrected Bandgap Reference in 0.5 μm CMOS Process" IEEE Transactions on Very Large Scale Integration (VLSI) Systems, vol. 19, No. 6, Jun. 2011, (5 pages total).

Quanzhen Duan et al. "A 1.2-V 4.2-ppm C High-Order Curvature-Compensated CMOS Bandgap Reference" IEEE Transactions on Circuits and Systems—I: Regular Papers, 2014, (9 pages total).

Bill Ma et al. "A Novel 1.2-V 4.5-ppm/° C Curvature-Compensated CMOS Bandgap Reference" IEEE Transactions on Circuits and Systems—I: Regular Papers, vol. 61, No. 4, Apr. 2014, (10 pages total).

Hironori Banba et al. "A CMOS Bandgap Reference Circuit with Sub-1-V Operation" IEEE Journal of Solid-State Circuits, col. 34, No. 5, May 1999, (5 pages total).

Communication dated Nov. 25, 2020 issued by the European Intellectual Property Office in counterpart European Application No. 20182546.0.

* cited by examiner

BANDGAP REFERENCE VOLTAGE GENERATING CIRCUIT

CROSS-REFERENCE TO RELATED APPLICATION

This application is based on and claims priority from Korean Patent Application No. 10-2019-0152595, filed on Nov. 25, 2019, in the Korean Intellectual Property Office, the disclosure of which is incorporated herein in its entirety by reference.

BACKGROUND

1. Field

The disclosure relates to a bandgap reference voltage generating circuit.

2. Description of Related Art

In general, a bandgap reference circuit supplies a bandgap voltage that maintains a constant voltage level regardless of changes in temperature.

Recently, various high-sensitivity devices, such as mobile devices that are supplied with power from batteries in which power supply voltages vary with use time, or next-generation wireless communication standards and inter-vehicle communication equipment that need high Signal-to-Noise Ratios (SNRs), require supply stable of fixed voltages.

Therefore, there is a need for a bandgap reference circuit that stably outputs a constant level voltage even when there are changes in temperature.

SUMMARY

Provided is a bandgap reference voltage generating circuit for generating a reference voltage that linearly varies with temperature changes.

The technical problems to be solved are not limited to the technical problems as described above, and thus other technical problems may be inferred.

Additional aspects will be set forth in part in the description which follows and, in part, will be apparent from the description, or may be learned by practice of the presented embodiments of the disclosure.

According to an aspect of the disclosure, there is provided a bandgap reference voltage generating circuit comprising: a first current generator configured to generate a first complementary-to-absolute temperature (CTAT) current and a first proportional-to-absolute temperature (PTAT) current; a second current generator configured to generate a second CTAT current and a second PTAT current; and an output circuit configured to output a reference voltage based on a difference between a first voltage based on the first CTAT current and the first PTAT current and a second voltage based on the second CTAT current and the second PTAT current, wherein the first CTAT current is same as the second CTAT current.

The reference voltage may be a value proportional to a difference between the first PTAT current and the second PTAT current.

The first current generator may comprises: a first operational amplifier configured to receive the first voltage and the second voltage as inputs, the first voltage being a voltage at a first node and the second voltage being a voltage at a second node; a first variable current source configured to output a current flowing from a power supply voltage terminal to the first node based on an output of the first operational amplifier; a first CTAT resistor connected between the first node and a ground voltage terminal; and a first PTAT resistor and a first transistor connected in series between the first node and the ground voltage terminal.

A base and a collector of the first transistor may be connected to the ground voltage terminal, and wherein the first PTAT resistor may be connected between the power supply voltage terminal and an emitter of the first transistor.

The second current generator may comprises: a second operational amplifier configured to receive the second voltage and a third voltage as inputs, the third voltage being a voltage at a third node; a second variable current source configured to output a current flowing from the power supply voltage terminal to the second node based on an output of the second operational amplifier; a third variable current source configured to output a current flowing from the power supply voltage terminal to the third node based on an output of the second operational amplifier; a second CTAT resistor connected between the second node and the ground voltage terminal; a second PTAT resistor and a second transistor connected in series between the second node and the ground voltage terminal; a third CTAT resistor connected between the third node and the ground voltage terminal; and a third transistor connected between the third node and the ground voltage terminal.

A base and a collector of the second transistor may be connected to the ground voltage terminal, wherein a base and a collector of the third transistor may be connected to the ground voltage terminal, and wherein the second PTAT resistor may be connected between the power supply voltage terminal and an emitter of the second transistor.

A size of the first transistor may be M times larger than a size of the third transistor, M being a natural number greater than 1, and a size of the second transistor may be N times larger than the size of the third transistor, N being a natural number greater than 1.

The output circuit may comprise: a fourth variable current source configured to output a current flowing from the power supply voltage terminal to an output node based on an output of the first operational amplifier; and an output resistor connected between the output node and the ground voltage terminal.

Each of the first variable current source, the second variable current source, the third variable current source, and the fourth variable current source may comprise at least one transistor connected in a cascade form.

The first current generator further may comprise: a variable resistor connected between the first PTAT resistor and the first transistor, and the second current generator may further comprise: a third PTAT resistor connected between the second PTAT resistor and the second transistor; and a third operational amplifier may be configured to receive a fourth voltage and a fifth voltage as inputs, wherein the fourth voltage is a voltage at a fourth node that is a connection node between the first PTAT resistor and the variable resistor and the fifth voltage is a voltage at a fifth node that is a connection node between the second PTAT resistor and the third PTAT resistor.

Magnitudes of the first PTAT resistor and the second PTAT resistor may be equal.

A resistance value of the variable resistor may be configured to be lowered based on a first PTAT current flowing from the first node to the fourth node becoming smaller than a second PTAT current flowing from the second node to the fifth node, while an output voltage of the third operational amplifier increases.

The output voltage of the third operational amplifier may become constant based on the resistance value of the variable resistor being lowered, when a magnitude of the first PTAT current increases, and based on the first PTAT current and the second PTAT current becoming equal.

The first PTAT current and the second PTAT current become equal, the output circuit is configured to output the reference voltage such that the reference voltage becomes constant regardless of changes in an absolute temperature.

The variable resistor may comprise a n-channel metal oxide semiconductor (NMOS) transistor, and wherein a source of the NMOS transistor is connected to the emitter of the first transistor, and a drain and a gate of the NMOS transistor are connected to the ground voltage terminal.

According to another aspect of the disclosure, there is provided a bandgap reference voltage generating circuit comprising: a first current generator configured to generate a first complementary-to-absolute temperature (CTAT) current and a first proportional-to-absolute temperature (PTAT) current; a second current generator configured to generate a second CTAT current and a second PTAT current; and an output circuit configured to output a reference voltage cancelling the first CTAT current and the second CTAT current and having a value proportional to a difference between the first PTAT current and the second PTAT current.

The first current generator may comprise: a first operational amplifier configured to receive a first voltage and a second voltage as inputs, the first voltage being a voltage at a first node and the second voltage being a voltage at a second node; a first variable current source configured to output a current flowing from a power supply voltage terminal to the first node based on an output of the first operational amplifier; a first CTAT resistor connected between the first node and a ground voltage terminal; and a first PTAT resistor and a first transistor connected in series between the first node and the ground voltage terminal.

According to another aspect of the disclosure, there is provided a bandgap reference voltage generating circuit comprising: a first operational amplifier; a first variable current source connected to a power source and configured to output a first current flowing from the power supply voltage terminal based on an output of the first operational amplifier; a first complementary-to-absolute temperature (CTAT) resistor and a first proportional-to-absolute temperature (PTAT) resistor connected in parallel to the first current source; a first transistor connected to the first resistor; a second operational amplifier; a second variable current source connected to the power source and configured to output a second current flowing from the power supply voltage terminal based on an output of the second operational amplifier; a second CTAT resistor and a second PTAT resistor connected in parallel to the first current source; a second transistor connected to the second PTAT resistor; and an output circuit configured to output a reference voltage based on a difference between a first voltage based on a first CTAT current across the first CTAT resistor and a first PTAT current across the first PTAT resistor and a second voltage based on a second CTAT current across the second CTAT resistor and a second PTAT current across the second PTAT resistor.

The first operational amplifier may be configured to receive a first voltage and a second voltage as inputs, the first voltage being a voltage across the first PTAT resistor and the first transistor and the second voltage being a voltage across the second PTAT resistor and the second transistor.

A third variable current source may be connected to the power source and configured to output a third current flowing from the power supply voltage terminal; and a second transistor may be connected to the third variable current source, wherein the second operational amplifier may be configured to receive the second voltage and a third voltage as inputs, the third voltage being a voltage across the third transistor.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
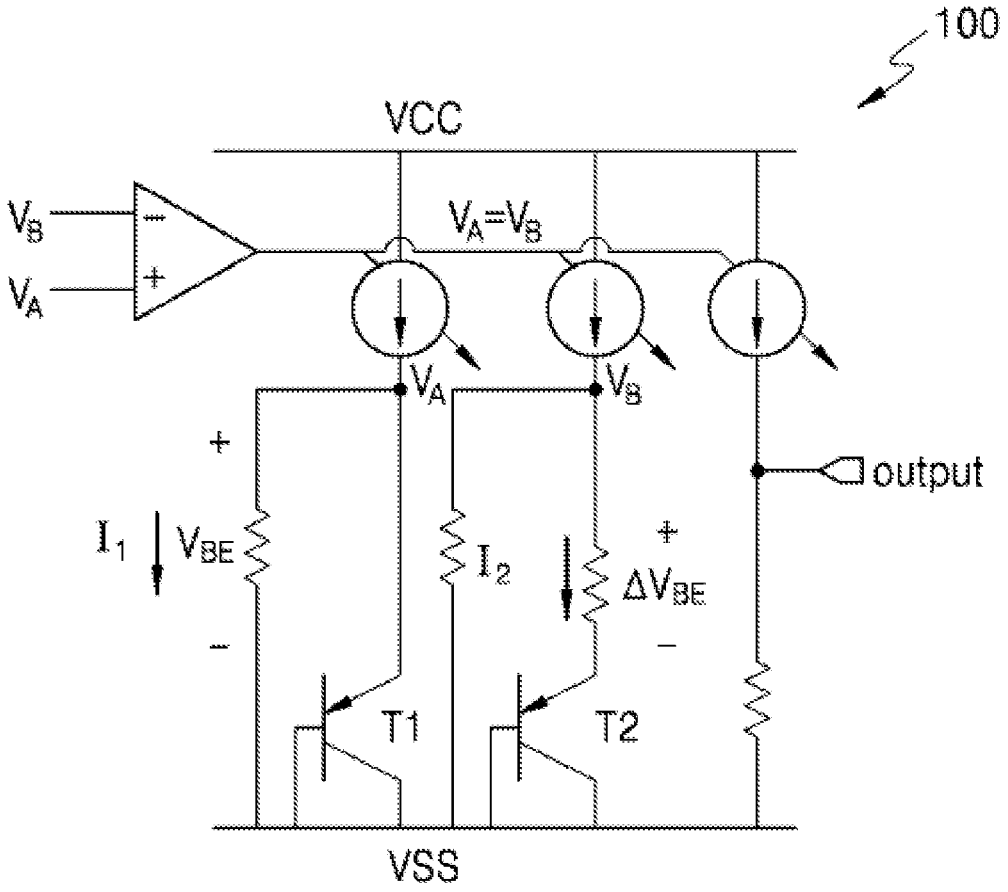
FIG. 1 is a circuit diagram illustrating an example of a related art bandgap reference voltage generating circuit.

Reference will now be made in detail to embodiments, examples of which are illustrated in the accompanying drawings, wherein like reference numerals refer to like elements throughout. In this regard, the example embodiments may have different forms and should not be construed as being limited to the descriptions set forth herein. Accordingly, the example embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

The terminology used herein are general terms that are currently widely used as possible, but may vary according to the intention or precedent of those skilled in the art, the emergence of a new technology, and the like. Also, in particular cases, the terms that are randomly selected may also be used, in which case the meanings thereof will be described in detail in the description of the corresponding example embodiments. Therefore, the terms used herein should be defined based on the meanings thereof and the contents throughout the example embodiments, rather than simply the names thereof.

Throughout the specification, when a part is referred to as being connected to another part, this may include not only being directly connected to another part, but also being electrically connected to another part with another element in between. Also, unless otherwise defined, when a part is referred to as including an element, this means that the part may further include other elements without excluding other elements.

It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

The disclosure will now be described more fully with reference to the accompanying drawings, in which example embodiments of the disclosure are shown. The disclosure may, however, embodied in many different forms and should not be construed as being limited to the example embodiments set forth herein.

FIG. 1 is a circuit diagram illustrating an example of a related art bandgap reference voltage generating circuit.

A circuit shown in FIG. 1 may be an example of a related art circuit that generates a bandgap reference voltage.

A semiconductor device may generate and use an internal voltage at different levels by using an externally supplied power supply voltage VCC and a ground voltage VSS.

To generate this internal voltage, a charge pumping method or a voltage down converting method may be used. Here, a reference voltage that is a reference of a level of the corresponding internal voltage may be generated, and the internal voltage may be generated by using the generated reference voltage.

A stable level reference voltage may have a constant level regardless of changes in a process, a voltage, or a temperature (PVT), and a bandgap reference voltage generating circuit may be used to generate such a reference voltage.

A related art bandgap reference voltage generating circuit 100 may include, in parallel, Bipolar Junction Transistors (BJTs) having different areas. For example, the related art bandgap reference voltage generating circuit 100 may be constructed such that a proportional-to-absolute temperature (PTAT) component and a complementary-to-absolute temperature (CTAT) component are combined, to output a voltage that is not sensitive to temperature changes.

Referring to FIG. 1, the related art bandgap reference voltage generating circuit 100 may include a transistor T1 and a transistor T2. The transistor T2 may be designed in size N times (wherein N is a natural number greater than 1) larger than the transistor T1.

A voltage $V_{BE}$ between a base and an emitter of the transistor T1 corresponding to temperature T may be expressed as in Equation 1 below:

$$V_{BE} = V_{G0} + [V_{BE}(T_R) - V_{G0}] * \frac{T}{T_R} - (\eta - \delta) * \frac{kT}{q} * \ln\left(\frac{T}{T_R}\right) \quad (1)$$

wherein $V_{G0}$ denotes a bandgap voltage at a temperature of 0 K, $T_R$ denotes a reference temperature, η denotes a parameter related to a change in a temperature of mobility, δ denotes a parameter related to a change in a temperature of a collector current, k denotes a Boltzmann constant, and q denotes a charge quantity of electrons. The voltage $V_{BE}$ may correspond to a CTAT component.

Also, $\Delta V_{BE}$ that corresponds to a difference between the voltage $V_{BE}$ between the base and the emitter of the transistor T1 and a voltage between a base and an emitter of the transistor T2 may be expressed as in Equation 2 below. $\Delta V_{BE}$ may correspond to a CTAT component.

$$\Delta V_{BE} = \frac{kT}{q} * \ln(N) \quad (2)$$

The related art bandgap reference voltage generating circuit 100 may generate a reference voltage based on a sum of the voltage $V_{BE}$ and the voltage $\Delta V_{BE}$, thereby supplying a reference voltage having a characteristic relatively resistant to temperature changes. However, since the voltage $V_{BE}$ includes a nonlinear element as in Equation 1, the reference voltage supplied by the related art bandgap reference voltage generating circuit 100 needs additional calibration.

Figure 2:
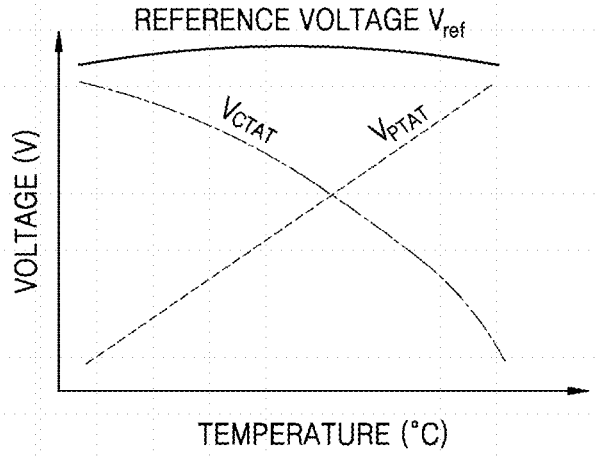
FIG. 2 is a graph illustrating an example of a reference voltage output from the related art bandgap reference voltage generating circuit.

FIG. 2 is a graph illustrating an example of a reference voltage output from a related art bandgap reference voltage generating circuit.

Referring to FIG. 2, $V_{CTAT}$ may correspond to a voltage having a complementary-to-absolute temperature (CTAT) characteristic. For example, $V_{CTAT}$ may correspond to the voltage $V_{BE}$ shown in FIG. 1. Also, $V_{PTAT}$ may correspond to a voltage having a proportional-to-absolute temperature (PTAT) characteristic. For example, $V_{PTAT}$ may correspond to the voltage $\Delta V_{BE}$ shown in FIG. 1.

A reference voltage $V_{ref}$ may correspond to a voltage that is finally output based on a sum of the voltage $V_{CTAT}$ and the voltage $V_{PTAT}$. Here, as described above with reference to FIG. 1, the output reference voltage $V_{ref}$ may also include a nonlinear element for a change in an absolute temperature, due to the nonlinear element included in the voltage $V_{CTAT}$.

To generate the reference voltage $V_{ref}$ at a stable level regardless of changes in the process, the voltage, or the temperature (PVT), calibration to solve nonlinearity is needed. For this, a technique that calibrates the distorted reference voltage $V_{ref}$ by determining a temperature range needing calibration and supplying an additional current through a separate device has been suggested. However, this technique does not calibrate a temperature coefficient but indirectly calibrates the reference voltage $V_{ref}$ through an additional device, and thus has a problem in accuracy of the calibration.

Also, a technique that cancels nonlinearity in a temperature range needing calibration through a separate device having a temperature coefficient opposite to a related art bandgap reference voltage generating circuit has been suggested. However, this technique additionally needs the same circuit as the related art bandgap reference voltage generating circuit and thus has a problem in that more than twice the power is consumed and more than twice an area is occupied. In addition, this technique has a problem in accuracy of calibration due to a performance difference or the like between devices having opposite temperature coefficients.

Therefore, FIGS. 3 through 7 provide a bandgap reference voltage generating circuit that improves accuracy of calibration and outputs a fixed reference voltage $V_{ref}$ regardless of changes in a process, a voltage, or a temperature. Here, the fixed reference voltage $V_{ref}$ may be output regardless of changes in the process, the voltage, and the temperature.

Figure 3:
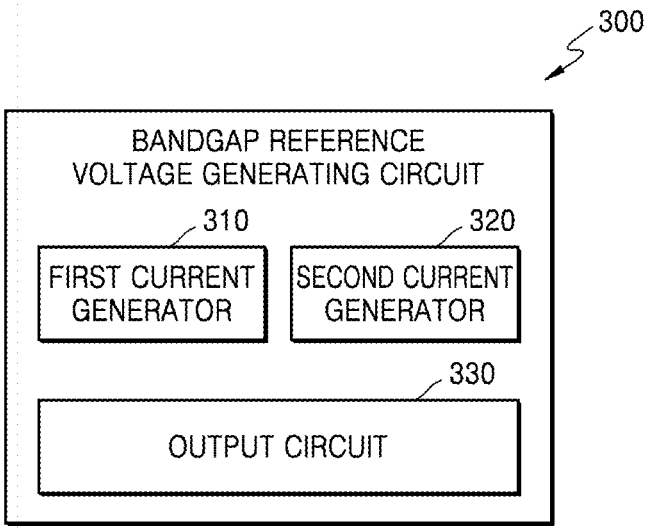
FIG. 3 is a block diagram illustrating a bandgap reference voltage generating circuit according to an example embodiment.

FIG. 3 is a block diagram illustrating a bandgap reference voltage generating circuit according to an example embodiment.

Referring to FIG. 3, a bandgap reference voltage generating circuit 300 may include a first current generator 310, a second current generator 320, and an output circuit 330.

The first current generator 310 may generate a first complementary-to-absolute temperature (CTAT) current and a first proportional-to-absolute temperature (PTAT) current.

The second current generator 320 may generate a second CTAT current and a second PTAT current.

The output circuit 330 may output a reference voltage based on a difference between a first voltage based on the first CTAT current and the first PTAT current and a second voltage based on the second CTAT current and the second PTAT current. Therefore, the reference voltage output from the output circuit 330 may have a value proportional to a difference between the first PTAT current and the second PTAT current regardless of the first CTAT current and the second CTAT current having nonlinearity. Hereinafter, the first current generator 310, the second current generator 320, and the output circuit 330 that form the bandgap reference voltage generating circuit 300 will be respectively described in detail with reference to FIG. 4.

Figure 4:
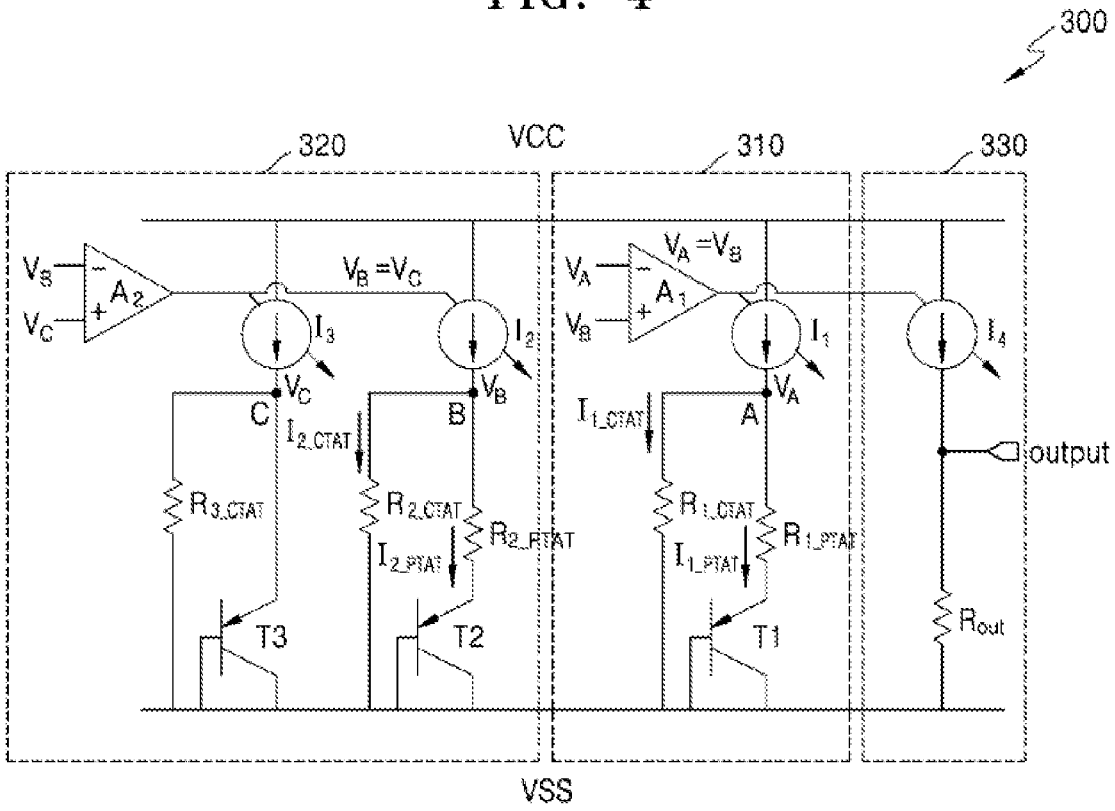
FIG. 4 is a circuit diagram illustrating the bandgap reference voltage generating circuit according to an example embodiment.

FIG. 4 is a circuit diagram illustrating a bandgap reference voltage generating circuit according to an example embodiment.

The first current generator 310 of the bandgap reference voltage generating circuit 300 may include a first operational amplifier $A_1$ that has a first voltage $V_A$ and a second voltage $V_B$ as inputs. The first voltage $V_A$ is the voltage at a first node A and the second voltage $V_B$ is the voltage at a second node B. The bandgap reference voltage generating circuit 300 may further include a first variable current source $I_1$ that determines a current flowing from a power supply voltage terminal VCC to the first node A based on an output of the first operational amplifier $A_1$, a first CTAT resistor $R_{1_CTAT}$ that is connected between the first node A and a ground voltage terminal VSS, and a first PTAT resistor $R_{1_PTAT}$ and a first transistor T1 that are connected in series between the first node A and the ground voltage terminal VSS.

Here, a base and a collector of the first transistor T1 may be connected to the ground voltage terminal VSS, and the first PTAT resistor $R_{1_PTAT}$ may be connected between the power supply voltage terminal VCC and an emitter of the first transistor T1.

The first CTAT resistor $R_{1_CTAT}$ and the first PTAT resistor $R_{1_PTAT}$ are not limited to those illustrated in FIG. 4 and may be formed of a combination of a plurality of identical units. Also, the first PTAT resistor $R_{1_PTAT}$ may correspond to a sum of resistance components of at least one transistor. The first variable current source may correspond to at least one transistor connected in a cascade form.

A first CTAT current $I_{1_CTAT}$ may correspond to a current flowing in the first CTAT resistor $R_{1_CTAT}$, a first PTAT current $I_{1_PTAT}$ may correspond to a current flowing in the first PTAT resistor $R_{1_PTAT}$ and the first transistor T1.

The second current generator 320 of the bandgap reference voltage generating circuit 300 may include a second operational amplifier $A_2$ that has a second voltage $V_B$ and a third voltage $V_C$ as inputs. The second voltage $V_B$ is the voltage at a second node B and the third voltage $V_C$ is the voltage at a third node C as inputs, a second variable current source $I_2$ that determines a current flowing from the power supply voltage terminal VCC to the second node B based on an output of the second operational amplifier $A_2$, a third variable current source $I_3$ that determines a current flowing from the power supply voltage terminal VCC to the third node C based on an output of the second operational amplifier $A_2$, a second CTAT resistor $R_{2_CTAT}$ that is connected between the second node B and the ground voltage terminal VSS, a second PTAT resistor $R_{2_PTAT}$ and a second transistor T2 that are connected in series between the second node B and the ground voltage terminal VSS, a third CTAT resistor $R_{3_CTAT}$ that is connected between the third node C and the ground voltage terminal VSS, and a third transistor T3 that is connected between the third node C and the ground voltage terminal VSS.

Here, a base and a collector of the second transistor T2 may be connected to the ground voltage terminal VSS, and a base and a collector of the third transistor T3 may be connected to the ground voltage terminal VSS. Also, the second PTAT resistor $R_{2_PTAT}$ may be connected between the power supply voltage terminal VCC and an emitter of the second transistor T2.

The second CTAT resistor $R_{2_CTAT}$, the second PTAT resistor $R_{2_PTAT}$, and the third CTAT resistor $R_{3_CTAT}$ are not limited to those illustrated in FIG. 4 and may be formed of a combination of a plurality of identical units. Also, the second PTAT resistor $R_{2_PTAT}$ may correspond to a sum of resistance components of at least one transistor. The second variable current source $I_2$ and the third variable current source $I_3$ may correspond to at least one transistor connected in a cascade form.

A second CTAT current $I_{2_CTAT}$ may correspond to a current flowing in the second CTAT resistor $R_{2_CTAT}$, and a second PTAT current $I_{2_PTAT}$ may correspond to a current flowing in the second PTAT resistor $R_{2_PTAT}$ and the second transistor T2.

A size of the first transistor T1 may be designed to be M times (wherein M is a natural number greater than 1) larger than a size of the third transistor T3, and a size of the second transistor T2 may be designed to be N times (wherein N is a natural number greater than 1) larger than the size of the third transistor T3.

The output circuit 330 may include a fourth variable current source $I_4$ that determines a current flowing from the power supply voltage terminal VCC to an output node based on an output of the first operational amplifier $A_1$ and an output resistor Rout that is connected between the output node and the ground voltage terminal VSS. The fourth variable current source $I_4$ may correspond to at least one transistor connected in a cascade form. According to an example embodiment, the fourth variable current source $I_4$ may include one or more transistors connected in a cascade form.

When the gain of the first operational amplifier $A_1$ is sufficiently large, the first node A and the second node B may form a virtual short circuit, and thus magnitudes of the first voltage $V_A$ and the second voltage $V_B$ may become the same. Also, since magnitudes of the first CTAT resistor $R_{1_CTAT}$ and the second CTAT resistor $R_{2_CTAT}$ are the same, magnitudes of the first CTAT current $I_{1_CTAT}$ and the second CTAT current $I_{2_CTAT}$ become the same.

The first PTAT current $I_{1_PTAT}$ and the second PTAT current $I_{2_PTAT}$ may be expressed as in Equation 3 Below.

$$\text{I1_PTAT} = \frac{\frac{kT}{q} * \ln(M)}{\text{R1_PTAT}} \tag{3}$$

-continued $$I2_PTAT = \frac{\frac{kT}{q} * \ln(N)}{R2_PTAT} \quad (3)$$

The first operational amplifier $A_1$ may output a voltage obtained by amplifying a difference between the first voltage $V_A$ and the second voltage $V_B$, and an amount of current flowing into the fourth variable current source $I_4$ of the output circuit 330 may be determined based on the output voltage. According to an example embodiment, a reference voltage may be output based on a product of the current flowing into the fourth variable current source $I_4$ and the output resistor Rout.

Here, since the magnitudes of the first CTAT current $I_{1_CTAT}$ and the second CTAT current $I_{2_CTAT}$ are the same and are cancelled, the output reference voltage may be independent of the first CTAT current $I_{1_CTAT}$ and the second CTAT current $I_{2_CTAT}$. Therefore, the reference voltage may have a value proportional to $I_{1_PTAT}$-$I_{2_PTAT}$ corresponding to a difference between magnitudes of the first PTAT current $I_{1_PTAT}$ and the second PTAT current $I_{2_PTAT}$.

Since the reference voltage is determined only by the first PTAT current $I_{1_PTAT}$ and the second PTAT current $I_{2_PTAT}$ that do not include nonlinear elements, as a temperature changes, the reference voltage may also linearly vary.

Figure 5:
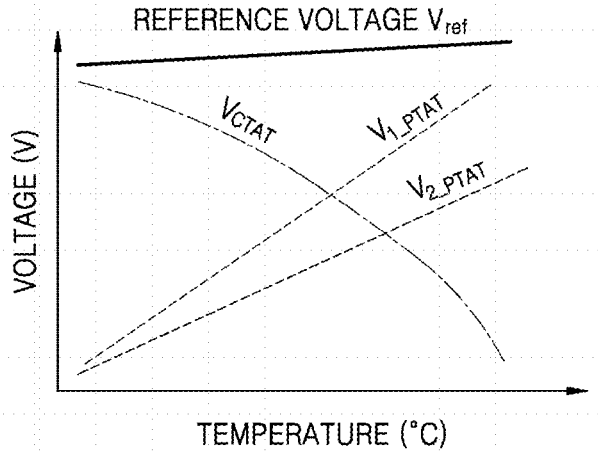
FIG. 5 is a graph illustrating a reference voltage output from the bandgap reference voltage generating circuit according to an example embodiment.

FIG. 5 is a graph illustrating a reference voltage output from a bandgap reference voltage generating circuit according to an example embodiment.

Referring to FIG. 5, $V_{CTAT}$ may correspond to a voltage having a CTAT characteristic. For example, $V_{CTAT}$ may correspond to voltages respectively across the first CTAT resistor $R_{1_CTAT}$ and the second CTAT resistor $R_{2_CTAT}$ shown in FIG. 4. As described above with reference to FIG. 4, since voltages respectively across the first CTAT resistor $R_{1_CTAT}$ and the second CTAT resistor $R_{2_CTAT}$ are the first voltage $V_A$ and the second voltage $V_B$, when the gain of the first operational amplifier $A_1$ is sufficiently large, the first node A and the second node B may form the virtual short circuit so that the magnitudes of the first voltage $V_A$ and the second voltage $V_B$ become the same.

$V_{1_PTAT}$ and $V_{2_PTAT}$ may correspond to voltages having PTAT characteristics. For example, $V_{1_PTAT}$ may correspond to a voltage across the first PTAT resistor $R_{1_PTAT}$ shown in FIG. 4, and $V_{2_PTAT}$ may correspond to a voltage across the second PTAT resistor $R_{2_PTAT}$ shown in FIG. 4.

A reference voltage $V_{ref}$ may be determined based on a difference between voltages respectively across the first CTAT resistor $R_{1_CTAT}$ and the second CTAT resistor $R_{2_CTAT}$ and a difference between voltages respectively across the first PTAT resistor $R_{1_PTAT}$ and the second PTAT resistor $R_{2_PTAT}$. Here, since the voltages respectively across the first CTAT resistor $R_{1_CTAT}$ and the second CTAT resistor $R_{2_CTAT}$ are the same, the reference voltage $V_{ref}$ may be determined only by the difference between the voltages respectively across the first PTAT resistor $R_{1_PTAT}$ and the second PTAT resistor $R_{2_PTAT}$.

Referring to FIG. 5, as the temperature increases, the reference voltage $V_{ref}$ may linearly vary in proportion to a difference value between $V_{1_PTAT}$ and $V_{2_PTAT}$.

Figure 6:
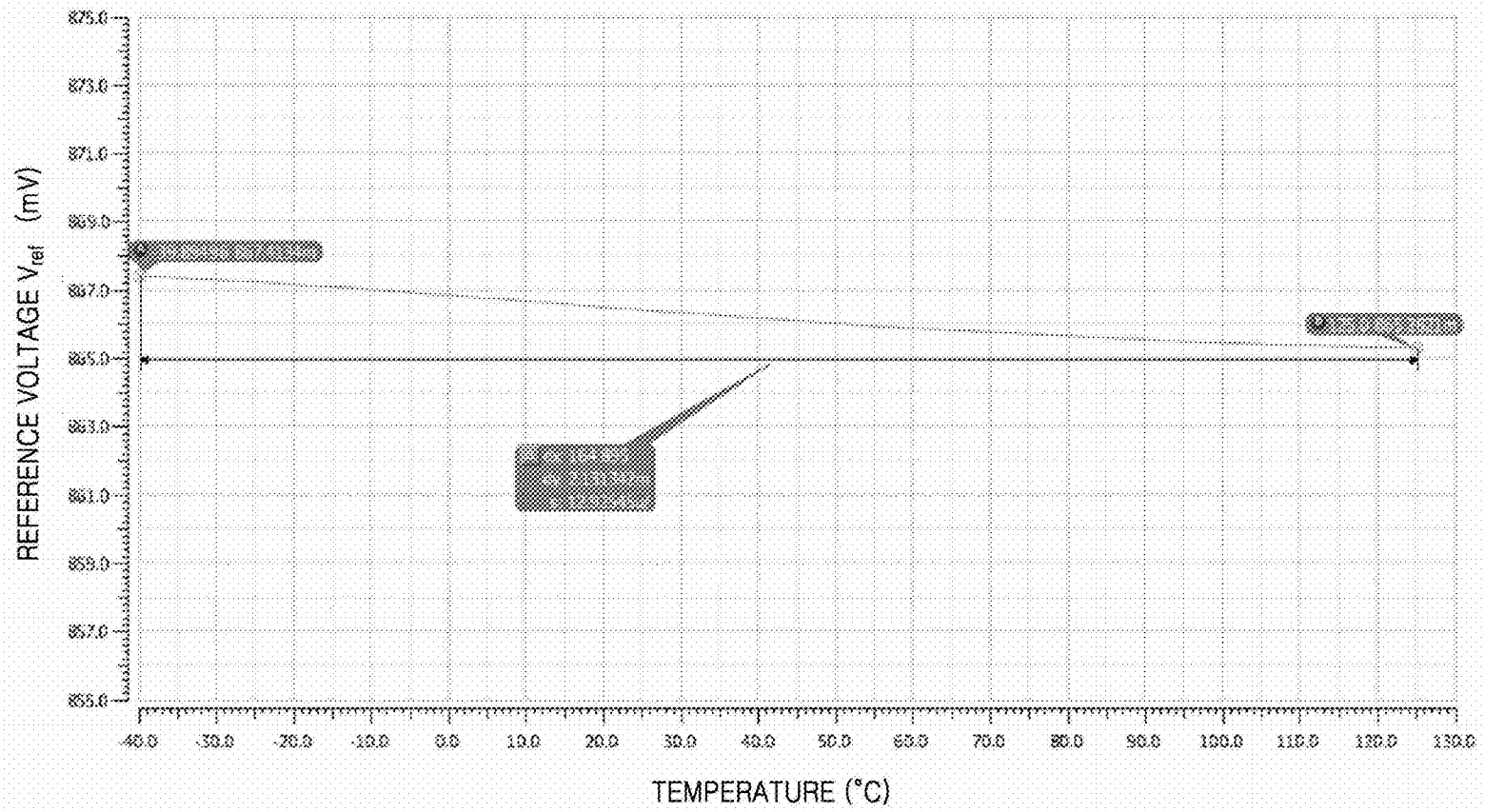
FIG. 6 is a graph illustrating the reference voltage output from simulating the bandgap reference voltage generating circuit according to an example embodiment.

FIG. 6 is a graph illustrating a reference voltage output from simulating a bandgap reference voltage generating circuit according to an example embodiment.

Referring to FIG. 6, in a simulation environment in which a temperature changes from −40° C. to 125° C., a reference voltage $V_{ref}$ output from the bandgap reference voltage generating circuit 300 may have a variation value of about 2.13 mV.

Also, a magnitude of the reference voltage $V_{ref}$ that varies with the change of the temperature from −40° C. to 125° C. may vary linearly.

Figure 7:
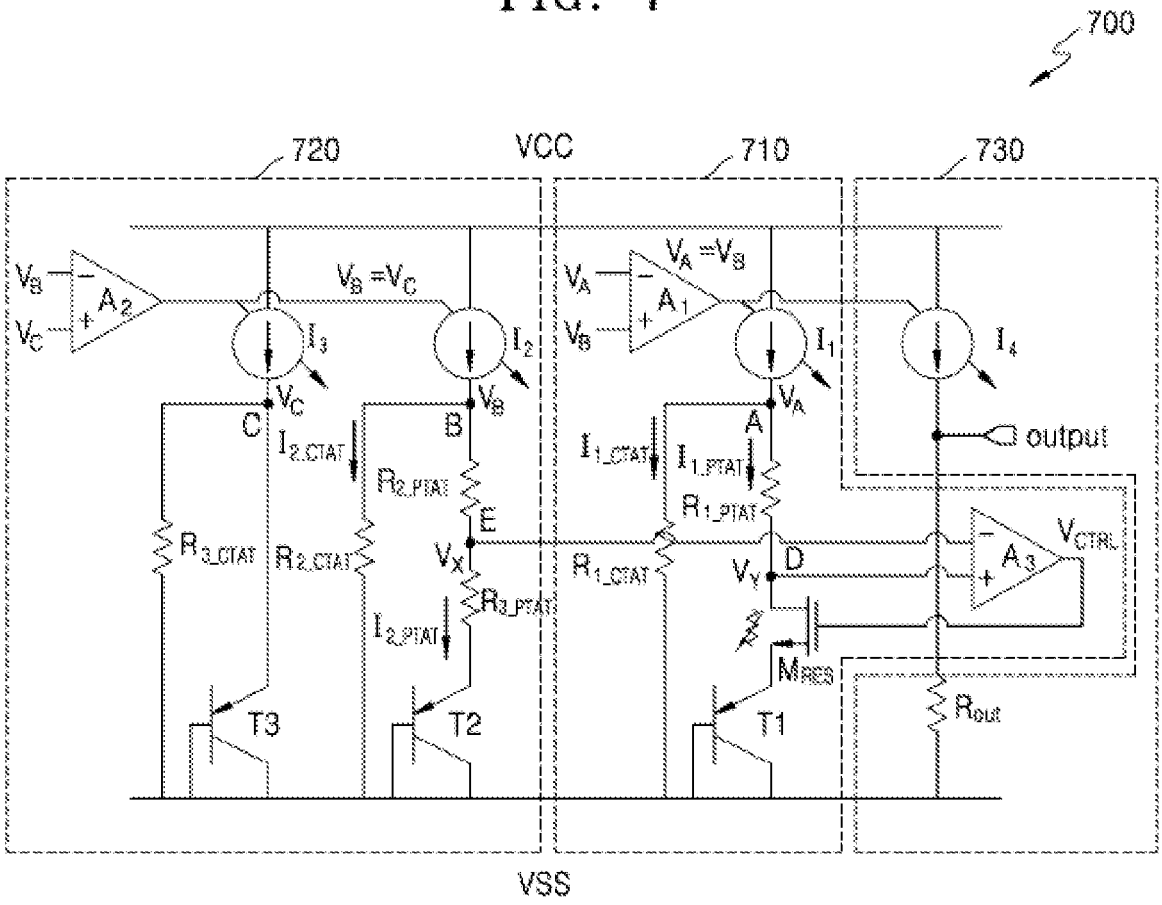
FIG. 7 is a circuit diagram illustrating a bandgap reference voltage generating circuit according to another example embodiment.

FIG. 7 is a circuit diagram illustrating a bandgap reference voltage generating circuit according to another example embodiment.

As described above with reference to FIG. 5, the reference voltage $V_{ref}$ generated by the bandgap reference voltage generating circuit 300 may be determined by the difference between the first PTAT current $I_{1_PTAT}$ and the second PTAT current $I_{2_PTAT}$. Therefore, the reference voltage $V_{ref}$ may be determined by the size of the first transistor T1, the size of the second transistor T2, the first PTAT resistor $R_{1_PTAT}$, and the second PTAT resistor $R_{2_PTAT}$.

To generate a constant reference voltage regardless of temperature changes, a ratio between the size of the first transistor T1 and the size of the second transistor T2 or a ratio between the first PTAT resistor $R_{1_PTAT}$ and the second PTAT resistor $R_{2_PTAT}$ may be adjusted to adjust the magnitudes of the first PTAT current $I_{1_PTAT}$ and the second PTAT current $I_{2_PTAT}$ so as to be the same.

However, due to a process error, the ratio between the size of the first transistor T1 and the size of the second transistor T2 or the ratio between the first PTAT resistor $R_{1_PTAT}$ and the second PTAT resistor $R_{2_PTAT}$ may be different from a value set at design. Even in this case, a resistance value may be readjusted to calibrate the magnitudes of the first PTAT current $I_{1_PTAT}$ and the second PTAT current $I_{2_PTAT}$ so as to be the same. FIG. 7 corresponds to a bandgap reference voltage generating circuit 700 for calibrating the magnitudes of the first PTAT current $I_{1_PTAT}$ and the second PTAT current $I_{2_PTAT}$ to be the same.

The bandgap reference voltage generating circuit 700 may include a first current generator 710, a second current generator 720, and an output circuit 730.

The first current generator 710 may include a construction of the first current generator 310 of the bandgap reference voltage generating circuit 300, and this is the same as described above with reference to FIG. 4.

The first current generator 710 may further include a variable resistor $M_{RES}$ that is connected between a first PTAT resistor $R_{1_PTAT}$ and a first transistor T1. The variable resistor $M_{RES}$ may correspond to a n-channel metal oxide semiconductor (NMOS) transistor. A source of the NMOS transistor may be connected to an emitter of the first transistor T1, and a drain and a gate of the NMOS transistor may be connected to a ground voltage terminal VSS. The variable resistor $M_{RES}$ is not limited to the NMOS transistor as shown in FIG. 7 and may be embodied as a single NMOS transistor or a plurality of NMOS transistors or a p-channel metal oxide semiconductor (PMOS) transistor.

The second current generator 720 may include a construction of the second current generator 320 of the bandgap reference voltage generating circuit 300, and this is the same as described above with reference to FIG. 4.

The second current generator 720 may further include a third PTAT resistor $R_{3_PTAT}$ that is connected between a second PTAT resistor $R_{2_PTAT}$ and a second transistor T2. The second current generator 720 may further include a third operational amplifier $A_3$ that has, as inputs, a fourth voltage $V_y$ at a fourth node D that is a connection node between the first PTAT resistor $R_{1_PTAT}$ and the variable resistor $M_{RES}$ and a fifth voltage $V_x$ at a fifth node E that is a connection node between the second PTAT resistor $R_{2_PTAT}$ and the third PTAT resistor $R_{3_PTAT}$.

Here, magnitudes of the first PTAT resistor $R_{1_PTAT}$ and the second PTAT resistor $R_{2_PTAT}$ may be the same. Therefore, when magnitudes of a first PTAT current $I_{1_PTAT}$ and a second PTAT current $I_{2_PTAT}$ vary, magnitudes of the fourth voltage $V_y$ applied to the fourth node D and the fifth voltage $V_x$ applied to the fifth node E also vary.

For example, when the first PTAT current $I_{1_PTAT}$ flowing from the first node A to the fourth node D becomes smaller than the second PTAT current $I_{2_PTAT}$ flowing from the second node B to the fifth node E, the fourth voltage $V_y$ becomes greater than the fifth voltage $V_x$. Due to this, an output voltage $V_{CTRL}$ of the third operational amplifier $A_3$ is increased, and a resistance value of the variable resistor $M_{RES}$ is lowered.

As the resistance value of the variable resistor $M_{RES}$ is lowered, feedback on a gradual increase in the magnitude of the first PTAT current $I_{1_PTAT}$ is continuously made. As the magnitude of the first PTAT current $I_{1_PTAT}$ gradually increases, when the first PTAT current $I_{1_PTAT}$ and the second PTAT current $I_{2_PTAT}$ become the same, the output voltage $V_{CTRL}$ of the third operational amplifier $A_3$ may become constant.

As a result, as the first PTAT current $I_{1_PTAT}$ and the second PTAT current $I_{2_PTAT}$ become the same, an output reference voltage may become constant regardless of an absolute temperature. As the variable resistor $M_{RES}$ and the third operational amplifier $A_3$ are further included as described above, a reference voltage that linearly varies with changes in the absolute temperature may be finely calibrated.

Figure 8:
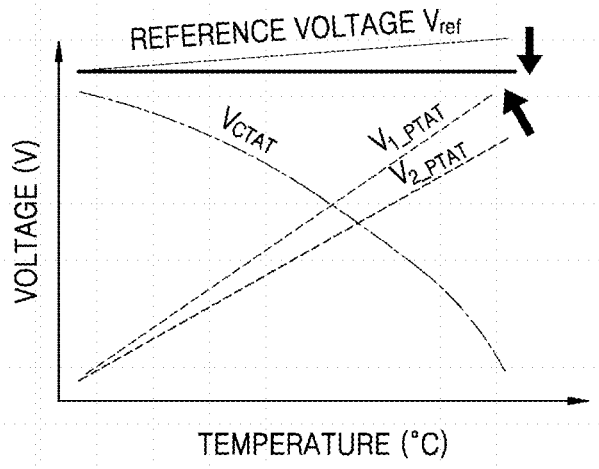
FIG. 8 is a graph illustrating a reference voltage output from the bandgap reference voltage generating circuit according to another example embodiment.

FIG. 8 is a graph illustrating a reference voltage output from a bandgap reference voltage generating circuit according to another example embodiment.

Referring to FIG. 8, $V_{CTAT}$ may correspond to a voltage having a CTAT characteristic. For example, $V_{CTAT}$ may correspond to voltages respectively across the first CTAT resistor $R_{1_CTAT}$ and the second CTAT resistor $R_{2_CTAT}$ shown in FIG. 7. Since the voltages respectively across the first CTAT resistor $R_{1_CTAT}$ and the second CTAT resistor $R_{2_CTAT}$ are the first voltage $V_A$ and the second voltage $V_B$, when the gain of the first operational amplifier $A_1$ is sufficiently large, the first node A and the second node B may form a virtual short circuit so that the magnitudes of the first voltage $V_A$ and the second voltage $V_B$ become the same.

$V_{1_PTAT}$ and $V_{2_PTAT}$ may correspond to voltages having PTAT characteristics. For example, $V_{1_PTAT}$ may correspond to a voltage across the first PTAT resistor $R_{1_PTAT}$ and the variable resistor $M_{RES}$ shown in FIG. 7, and $V_{2_PTAT}$ may correspond to a voltage across the second PTAT resistor $R_{2_PTAT}$ and the third PTAT resistor $R_{3_PTAT}$ shown in FIG. 7.

Since the voltages respectively across the first CTAT resistor $R_{1_CTAT}$ and the second CTAT resistor $R_{2_CTAT}$ are the same, a reference voltage $V_{ref}$ may be determined only by a difference value between $V_{1_PTAT}$ and $V_{2_PTAT}$. Here, as the third operational amplifier $A_3$ is further included, the variable resistor $M_{RES}$ may be adjusted so that $V_{1_PTAT}$ and $V_{2_PTAT}$ have the same value. Therefore, as shown in FIG. 8, as $V_{1_PTAT}$ and $V_{2_PTAT}$ have the same value, the reference voltage $V_{ref}$ may have a constant value regardless of the absolute temperature.

Figure 9:
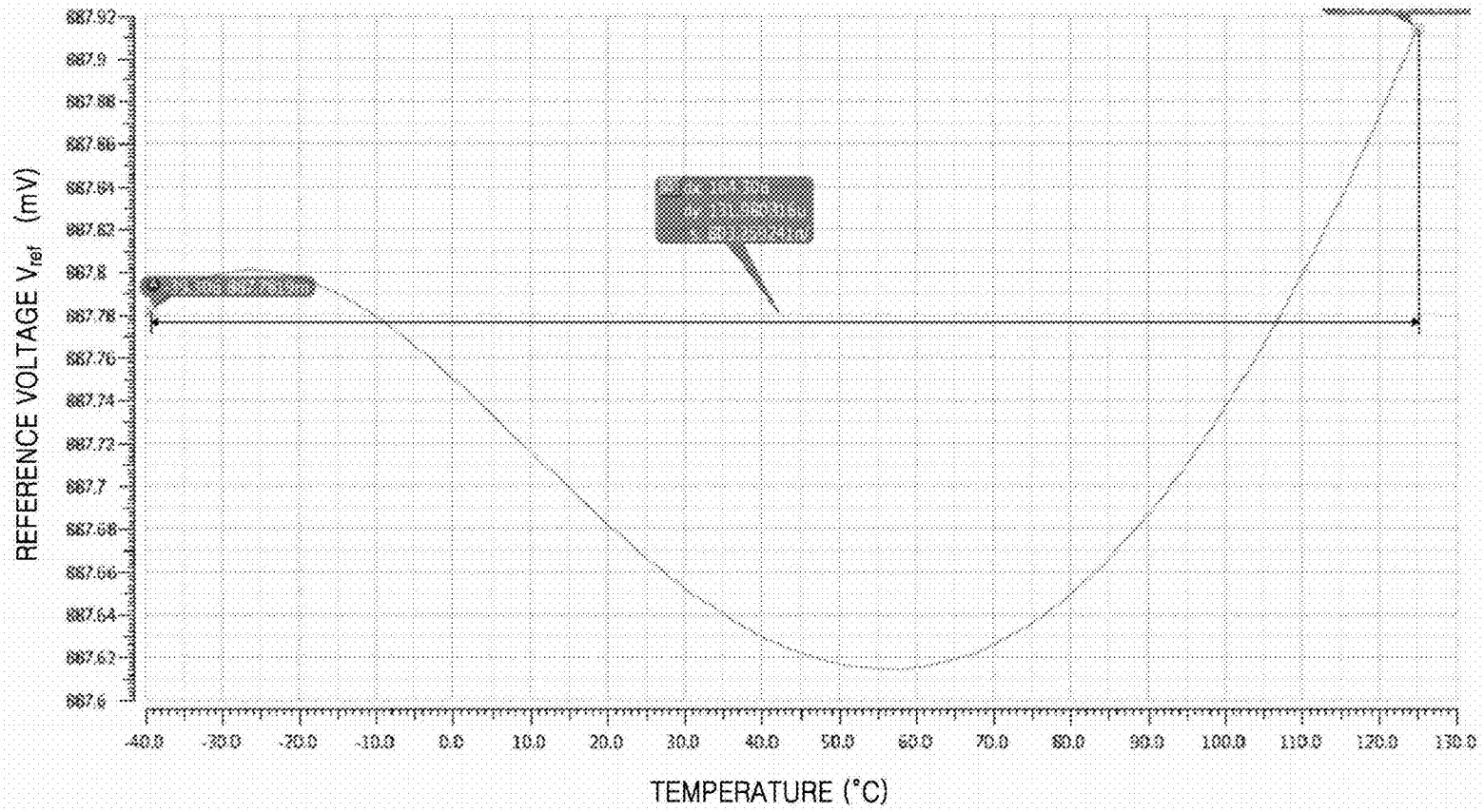
FIG. 9 is a graph illustrating the reference voltage output from simulating the bandgap reference voltage generating circuit according to another example embodiment.

FIG. 9 is a graph illustrating a simulation of a reference voltage output from a bandgap reference voltage generating circuit according to another example embodiment.

Referring to FIG. 9, in a simulation environment in which a temperature changes from −40° C. to 125° C., a reference voltage $V_{ref}$ output from the bandgap reference voltage generating circuit 700 may have a constant voltage value within an error range of 130 μV.

Figure 10:
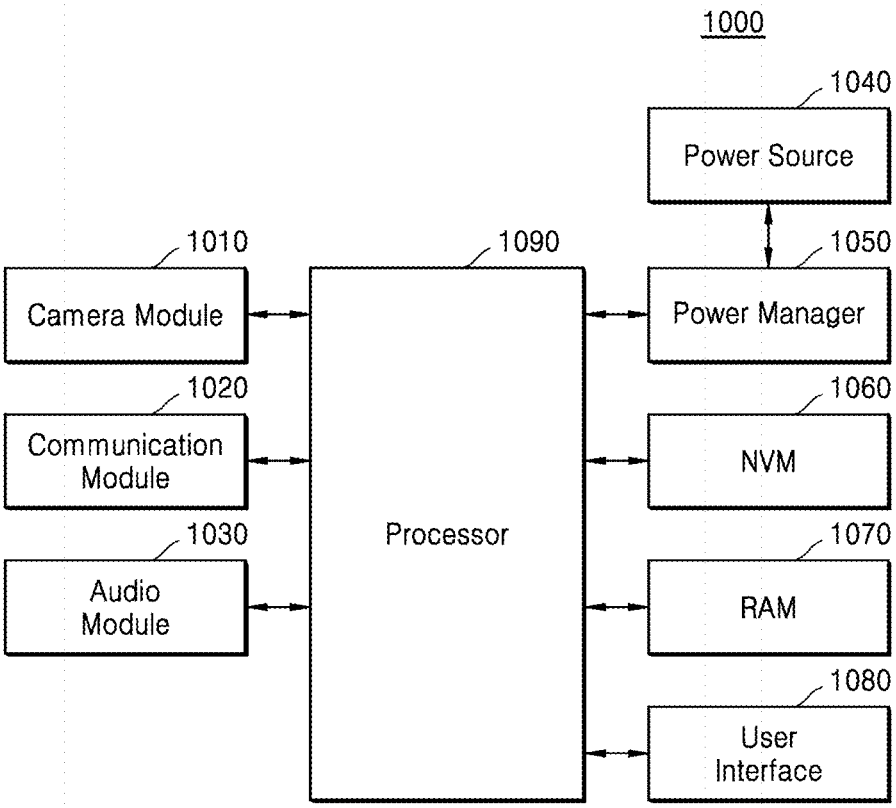
FIG. 10 is a block diagram illustrating a mobile electronic device according to an example embodiment.

FIG. 10 is a block diagram illustrating a mobile electronic device according to an example embodiment.

A mobile electronic device 1000 may include a camera module 1010, a wireless communication module 1020, an audio module 1030, a power source 1040, a power manager 1050, a nonvolatile memory 1060, random access memory (RAM) 1070, a user interface 1080, and a processor 1090. For example, the mobile electronic device 1000 may include a portable terminal, a Personal Digital Assistant (PDA), a Personal Media Player (PMP), a digital camera, a smartphone, a smartwatch, a tablet, a wearable device, or the like.

The camera module 1010 may include a lens, an image sensor, an imaging processor, and the like. The camera module 1010 may receive light through the lens, and the image sensor and the imaging processor may generate an image based on the received light.

The wireless communication module 1020 may include an antenna, a transceiver, and a modem. The wireless communication module 1020 may communicate with the outside of the mobile electronic device 1000 according to various wireless communication protocols such as 5G, Long Term Evolution (LTE), World Interoperability for Microwave Access (WiMax), Global System for Mobile communication (GSM), Code Division Multiple Access (CDMA), Bluetooth, Near Field Communication (NFC), Wireless Fidelity (WiFi), Radio Frequency Identification (RFID), and the like.

The audio module 1030 may process an audio signal by using an audio signal processor. The audio module 1030 may be provided with an audio input through a microphone or may provide an audio output through a speaker.

The power source 1040 may provide power needed by the mobile electronic device 1000. As an example, the power source 1040 may be a battery included in the mobile electronic device 1000, and the battery may be, for example, a lithium-ion battery. As another example, the power source 1040 may be a power adapter (or a travel adapter) external to the mobile electronic device 1000.

The power manager 1050 may manage power used for an operation of the mobile electronic device 1000. For example, the power manager 1050 may stabilize a voltage applied from the power source 1040 and output the stabilized voltage. The power manager 1050 may include at least one selected from the bandgap reference voltage generating circuit 300 according to an embodiment of the disclosure and the bandgap reference voltage generating circuit 700 according to another embodiment of the disclosure. Therefore, in a sophisticated circuit structure needing a high Signal-to-Noise Ratio (SNR) performance, the power manager 1050 may supply a stable and linear voltage to embody the mobile electronic device 1000 insensitive to variations in an external voltage. Also, the power manager 1050 may be embodied in the form of a power management integrated circuit (PMIC) or an integrated voltage regulator (IVR). The power manager 1050 may supply power to components (or Intellectual Properties (IPs)) of the mobile electronic device 1000. For example, at least one selected from the camera module 1010, the wireless communication module 1020, the audio module 1030, the nonvolatile memory 1060, the RAM 1070, the user interface 1080, and the processor 1090 included in the mobile electronic device 1000 may operate using a voltage supplied from the power manager 1050.

The nonvolatile memory 1060 may store data needing to be preserved regardless of power supply. For example, the nonvolatile memory 1060 may include at least one selected from NAND-type Flash Memory, Phase-change RAM (PRAM), Magnetoresistive RAM (MRAM), Resistive RAM (ReRAM), Ferro-electric RAM (FRAM), NOR-type Flash Memory, and the like.

The RAM 1070 may store data used for an operation of the mobile electronic device 1000. For example, the RAM 1070 may be used as a working memory, an operation memory, a buffer memory, or the like of the mobile electronic device 1000. The RAM 1070 may temporarily store data that is processed or to be processed by the processor 1090.

The user interface 1080 may interface between a user and the mobile electronic device 1000 under control of the processor 1090. For example, the user interface 1080 may include an input interface such as a keyboard, a keypad, buttons, a touch panel, a touch screen, a touch pad, a touch ball, a camera, a microphone, a gyroscope sensor, a vibration sensor, or the like. Also, the user interface 1080 may include an output interface such as a display device, a motor, or the like. For example, the display device may include one or more selected from a Liquid Crystal Display (LCD), a Light Emitting Diode (LED) display, an Organic LED (OLED) display, an Active Matrix OLED (AMOLED) display, and the like.

The processor 1090 may control an overall operation of the mobile electronic device 1000. The camera module 1010, the wireless communication module 1020, the audio module 1030, the nonvolatile memory 1060, and the RAM 1070 may execute a user command provided through the user interface 1080 under control of the processor 1090. Alternatively, the camera module 1010, the wireless communication module 1020, the audio module 1030, the nonvolatile memory 1060, and the RAM 1070 may provide the user with services through the user interface 1080 under control of the processor 1090. The processor 1090 may include a plurality of core units, an internal memory, a memory interface, and other components, and the core units may include at least one core. For example, the processor 1090 may be embodied as a Central Processing Unit (CPU), an Application Processor (AP), or Mobile Data Access Pilot (MoDAP) or may be embodied as a processing logic included in the CPU, the AP, or the MoDAP. The processing unit 1090 may be embodied as a System on Chip (SoC).

The disclosure has been particularly shown and described with reference to exemplary embodiments thereof. It will be understood by those skilled in the art that various changes in form and details may be made therein without departing from the spirit and scope of the disclosure as defined by the appended claims. The exemplary embodiments should be considered in descriptive sense only and not for purposes of limitation. Therefore, the scope of the disclosure is defined not by the detailed description of the disclosure but by the appended claims, and all differences within the scope will be construed as being included in the disclosure.

Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A bandgap reference voltage generating circuit comprising:

a first current generator configured to generate a first complementary-to-absolute temperature (CTAT) current and a first proportional-to-absolute temperature (PTAT) current, the first current generator comprising a first operational amplifier, a first variable current source, a first CTAT resistor, a first PTAT resistor and a first transistor;

a second current generator configured to generate a second CTAT current and a second PTAT current; and an output circuit configured to output a reference voltage based on a difference between a first voltage based on the first CTAT current and the first PTAT current and a second voltage based on the second CTAT current and the second PTAT current, wherein the first CTAT current is same as the second CTAT current, wherein the second current generator comprises:

a second operational amplifier configured to receive the second voltage and a third voltage as inputs, the third voltage being a voltage at a third node;

a second variable current source configured to output a current flowing from a power supply voltage terminal to a second node based on an output of the second operational amplifier;

a third variable current source configured to output a current flowing from the power supply voltage terminal to the third node based on an output of the second operational amplifier;

a second CTAT resistor connected between the second node and a ground voltage terminal;

a second PTAT resistor and a second transistor connected in series between the second node and the ground voltage terminal;

a third CTAT resistor connected between the third node and the ground voltage terminal; and a third transistor connected between the third node and the ground voltage terminal.

2. The bandgap reference voltage generating circuit of claim 1, wherein the reference voltage has a value proportional to a difference between the first PTAT current and the second PTAT current.

3. The bandgap reference voltage generating circuit of claim 1, wherein the first current generator comprises:

the first operational amplifier configured to receive the first voltage and the second voltage as inputs, the first voltage being a voltage at a first node and the second voltage being a voltage at the second node;

the first variable current source configured to output a current flowing from the power supply voltage terminal to the first node based on an output of the first operational amplifier;

the first CTAT resistor connected between the first node and the ground voltage terminal; and the first PTAT resistor and the first transistor connected in series between the first node and the ground voltage terminal.

4. The bandgap reference voltage generating circuit of claim 3, wherein a base and a collector of the first transistor are connected to the ground voltage terminal, and wherein the first PTAT resistor is connected between the power supply voltage terminal and an emitter of the first transistor.

5. The bandgap reference voltage generating circuit of claim 3, wherein a base and a collector of the second transistor are connected to the ground voltage terminal, wherein a base and a collector of the third transistor are connected to the ground voltage terminal, and wherein the second PTAT resistor is connected between the power supply voltage terminal and an emitter of the second transistor.

6. The bandgap reference voltage generating circuit of claim 5, wherein a size of the first transistor is M times larger than a size of the third transistor, M being a natural number greater than 1, and a size of the second transistor is N times larger than the size of the third transistor, N being a natural number greater than 1.

7. The bandgap reference voltage generating circuit of claim 3, wherein the output circuit comprises:

a fourth variable current source configured to output a current flowing from the power supply voltage terminal to an output node based on an output of the first operational amplifier; and an output resistor connected between the output node and the ground voltage terminal.

8. The bandgap reference voltage generating circuit of claim 7, wherein each of the first variable current source, the second variable current source, the third variable current source, and the fourth variable current source comprises at least one transistor connected in a cascade form.

9. The bandgap reference voltage generating circuit of claim 3, wherein the first current generator further comprises:

a variable resistor connected between the first PTAT resistor and the first transistor, and the second current generator further comprises:

a third PTAT resistor connected between the second PTAT resistor and the second transistor; and a third operational amplifier is configured to receive a fourth voltage and a fifth voltage as inputs, wherein the fourth voltage is a voltage at a fourth node that is a connection node between the first PTAT resistor and the variable resistor and the fifth voltage is a voltage at a fifth node that is a connection node between the second PTAT resistor and the third PTAT resistor.

10. The bandgap reference voltage generating circuit of claim 9, wherein magnitudes of the first PTAT resistor and the second PTAT resistor are equal.

11. The bandgap reference voltage generating circuit of claim 10, wherein a resistance value of the variable resistor is configured to be lowered based on a first PTAT current flowing from the first node to the fourth node becoming smaller than a second PTAT current flowing from the second node to the fifth node, while an output voltage of the third operational amplifier increases.

12. The bandgap reference voltage generating circuit of claim 11, wherein the output voltage of the third operational amplifier becomes constant based on the resistance value of the variable resistor being lowered, when a magnitude of the first PTAT current increases, and based on the first PTAT current and the second PTAT current becoming equal.

13. The bandgap reference voltage generating circuit of claim 12, wherein, when the first PTAT current and the second PTAT current become equal, the output circuit is configured to output the reference voltage such that the reference voltage becomes constant regardless of changes in an absolute temperature.

14. The bandgap reference voltage generating circuit of claim 9, wherein the variable resistor comprises a n-channel metal oxide semiconductor (NMOS) transistor, and wherein a source of the NMOS transistor is connected to an emitter of the first transistor, and a drain and a gate of the NMOS transistor are connected to the ground voltage terminal.

15. A bandgap reference voltage generating circuit comprising:

a first current generator configured to generate a first complementary-to-absolute temperature (CTAT) current and a first proportional-to-absolute temperature (PTAT) current, the first current generator comprising a first operational amplifier, a first variable current source, a first CTAT resistor, a first PTAT resistor and a first transistor, and the first operational amplifier configured to receive a first voltage and a second voltage as inputs, the first voltage being a voltage at a first node and the second voltage being a voltage at a second node;

a second current generator configured to generate a second CTAT current and a second PTAT current; and an output circuit configured to output a reference voltage cancelling the first CTAT current and the second CTAT current and having a value proportional to a difference between the first PTAT current and the second PTAT current, wherein the second current generator comprises:

a second operational amplifier configured to receive the second voltage and a third voltage as inputs, the third voltage being a voltage at a third node;

a second variable current source configured to output a current flowing from a power supply voltage terminal to the second node based on an output of the second operational amplifier;

a third variable current source configured to output a current flowing from the power supply voltage terminal to the third node based on an output of the second operational amplifier;

a second CTAT resistor connected between the second node and a ground voltage terminal;

a second PTAT resistor and a second transistor connected in series between the second node and the ground voltage terminal;

a third CTAT resistor connected between the third node and the ground voltage terminal; and a third transistor connected between the third node and the ground voltage terminal.

16. The bandgap reference voltage generating circuit of claim 15, wherein the first current generator comprises:

a first variable current source configured to output a current flowing from the power supply voltage terminal to the first node based on an output of the first operational amplifier;

a first CTAT resistor connected between the first node and the ground voltage terminal; and a first PTAT resistor and a first transistor connected in series between the first node and the ground voltage terminal.

17. A bandgap reference voltage generating circuit comprising:

a first operational amplifier;

a first variable current source connected to a power source and configured to output a first current flowing from the power source based on an output of the first operational amplifier;

a first transistor connected to a first proportional-to-absolute temperature (PTAT) resistor;

a first complementary-to-absolute temperature (CTAT) resistor connected in parallel with a series combination of the first PTAT and the first transistor;

a second operational amplifier;

a second variable current source connected to the power source and configured to output a second current flowing from the power source based on an output of the second operational amplifier;

a second transistor connected to a second PTAT resistor;

a second CTAT resistor connected in parallel with a series combination of the second PTAT resistor and the second transistor; and an output circuit configured to output a reference voltage based on a difference between a first voltage based on a first CTAT current through the first CTAT resistor and a first PTAT current through the first PTAT resistor and a second voltage based on a second CTAT current through the second CTAT resistor and a second PTAT current through the second PTAT resistor.

18. The bandgap reference voltage generating circuit of claim 17, wherein the first operational amplifier is configured to receive the first voltage and the second voltage as inputs, the first voltage being a voltage across the first PTAT resistor and the first transistor and the second voltage being a voltage across the second PTAT resistor and the second transistor.

19. The bandgap reference voltage generating circuit of claim 18, further comprising:

a third variable current source connected to the power source and configured to output a third current flowing from the power source; and a second transistor connected to the third variable current source, wherein the second operational amplifier is configured to receive the second voltage and a third voltage as inputs, the third voltage being a voltage across the third transistor.

* * * * *